United States Patent [19]

Nakamura et al.

[11] Patent Number: 4,913,346

[45] Date of Patent: Apr. 3, 1990

[54] ROTARY WASHING NOZZLE

[75] Inventors: Tatsumi Nakamura; Yasunori Takeshige, both of Yokkaichi, Japan

[73] Assignee: Tosoh Corporation, Shin-nanyo, Japan

[21] Appl. No.: 279,562

[22] Filed: Dec. 5, 1988

[30] Foreign Application Priority Data

Dec. 25, 1987 [JP] Japan ..... 62-327379

[51] Int. Cl.[4] ..... B05C 5/00; B05B 3/04; B05B 3/12

[52] U.S. Cl. ..... 239/225.1; 239/240

[58] Field of Search ..... 239/263.1, 225.1, 240; 310/66, 154, 156

[56] References Cited

U.S. PATENT DOCUMENTS

| | | | |
|---|---|---|---|
| 2,534,520 | 12/1950 | Katcher | 310/66 |
| 3,867,655 | 2/1975 | Stengel et al. | 310/66 |
| 3,896,997 | 7/1975 | Sallows | 239/240 |
| 4,268,769 | 5/1981 | Dorner et al. | 310/154 |
| 4,443,906 | 4/1984 | Tucker et al. | 310/156 |
| 4,798,334 | 1/1989 | Harrington | 239/263.1 |

*Primary Examiner*—Andres Kashnikow
*Assistant Examiner*—Karen B. Merritt
*Attorney, Agent, or Firm*—Oblon, Spivak, McClelland, Maier & Neustadt

[57] ABSTRACT

A rotary washing nozzle includes a rotating portion provided with blowing nozzles of washing fluid and a rotational shaft directly connected to the rotating portion, a part of the rotational shaft being allowed to rotate through the transmission of magnetic force as a mechanism.

2 Claims, 1 Drawing Sheet

ROTARY WASHING NOZZLE

BACKGROUND OF THE INVENTION

The present invention relates to a washing device using the injection of washing fluid such as water etc.

When washing a reactor etc. which is most often used in the chemical industry, after the completion of reaction and after collection of the reaction product, a washer with a rotary washing nozzle is generally used.

Such a washer having been conventionally used is of a type driven by the force of washing fluid.

Such device is operated in a manner that the pressure of washing fluid is converted to vortex flow at the guide section and this is impacted onto the rotary vanes directly connected to the rotational shaft to allow the shaft to rotate and to allow the injection nozzles of washing fluid to rotate.

The washer of the type driven by the force of washing fluid as mentioned is relatively simple in the mechanism, but the subtle adjustment of the number of revolution is difficult since it is operated while adjusting the number of revolution through the balance of resistance between the pressure of washing fluid and the slidably moving portions such as rotational shaft portion etc.

Moreover, it is impossible to adjust individually the pressure of washing fluid and the number of revolution.

Furthermore, when used for a long period of time, there arises a problem of wear in the slidably moving portions. This causes a change in the slidably moving resistance which also effects the number of revolution and results in the problems such as lowering in the washing effect etc.

As a result of the investigations on the rotary washing nozzle without drawbacks as mentioned in consideration of problems above, the inventors have completed a rotary washing nozzle, wherein the adjustments of number of revolution, fluid flow, pressure of washing fluid, etc, are easy and yet the maintenance is also simple, by making the rotational mechanism of the nozzle specific.

SUMMARY OF THE INVENTION

The invention relates to a rotary washing nozzle having a rotating portion provided with blowing nozzles of washing fluid and a rotational shaft directly connected to said rotating portion, a part of said rotational shaft being allowed to rotate through the transmission of magnetic force as a mechanism.

DETAILED DESCRIPTION OF THE INVENTION

Figure 1:
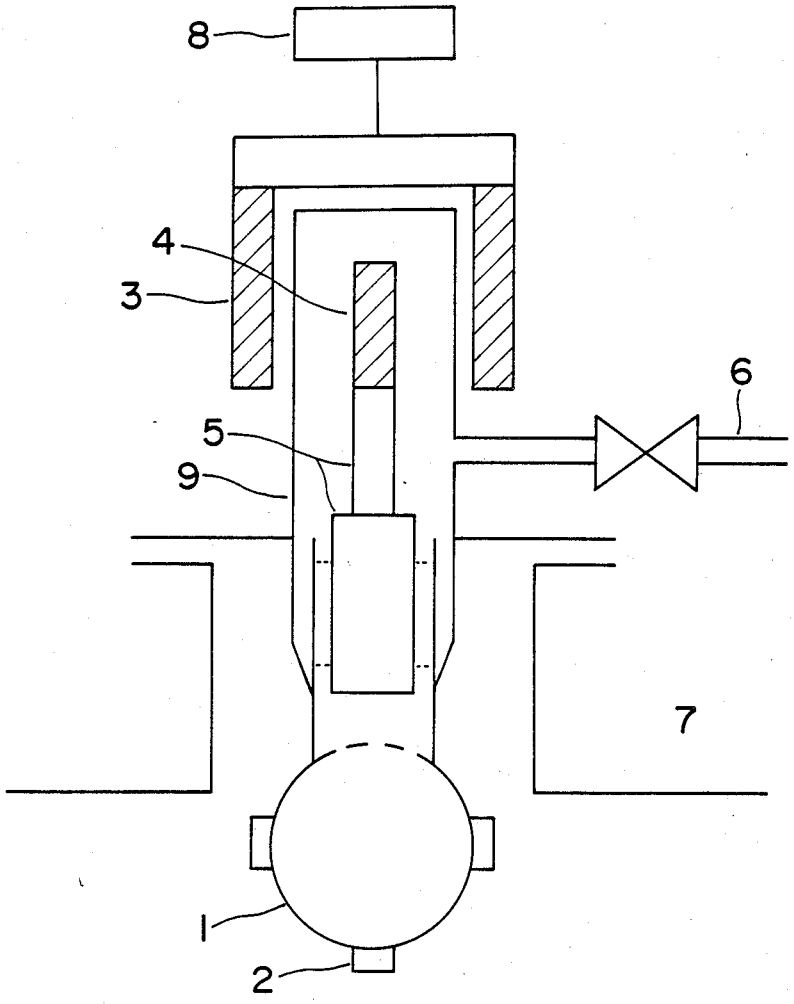
FIG. 1 is a longitudinal section of the device showing one embodiment of the invention.

In following, the invention will be illustrated in detail based on the drawing.

FIG. 1 is a longitudinal section of the device showing one embodiment of the invention. In the figure, numeral 1 is a rotating portion with blowing nozzles for discharging cleaning fluid, for example, water, numeral 2 is a blowing nozzle of fluid, numeral 3 is an outer magnetic portion, numeral 4 is an inner magnetic portion, numeral 5 is a rotational shaft, numeral 6 is a pipe for introducing the fluid, numeral 7 is a vessel to be washed, numeral 8 is a drive portion for rotating the outer magnetic portion, and numeral 9 is a mantle of the rotational axis, respectively. Due to the fact that the inner magnetic portion 4 and the outer magnetic portion 3 have opposite polarities, the rotation of the outer magnetic portion 3 by the drive portion 8 will cause the rotation of the inner magnetic portion 4.

The fluid (water is used usually) introduced form the pipe 6 for introducing the fluid, enters into the mantle 9 of the rotational shaft 5, is introduced to the rotating portion 1 with blowing nozzles, and is injected from the nozzles 2. The rotating portion provided with the rotational axis and the nozzles is tightly closed by the mantle 9 and rotates interlocking with the inner magnetic portion, which rotates accompanying with the rotation of outer magnetic portion driven by the drive portion of rotation 8.

Because of the structure of the invention as mentioned above, the adjustment of the rotational speed of the nozzle-rotating portion and that of the fluid pressure of washing liquor can be operated irrespectively.

Further, it is also possible to attach a mechanism that utilizes the fluid pressure of washing fluid by providing such vanes on a part of the rotational axis as give rise to the repellant force upon contacting with fluid flow by other ways.

The invention exerts following effects:

(1) It is possible to adjust individually and yet easily the pressure of washing fluid and the rotational speed of rotating nozzle.

(2) In conventional mechanism of the type driven by the force of washing fluid, the rotational speed tended to become unnecessarily high when using high-pressure fluid as a washing fluid which tends to unnecessarily wear moving parts. With the device of the invention, however, the slidably moving portion wears less and the maintenance is simple since the rotational speed can be properly adjusted.

(3) Since the rotational force due to the force of washing fluid alone as in the case of conventional instruments is not the primary drive source, by using the intensive magnetic force as a drive source, stable condition of rotation not affected by the resistance of slidably moving portion etc. can be achieved by the present invention. Super low-speed rotation (2 revolutions/minute) which has been impossible with the conventional type driven by the force of washing fluid can be performed in the stable condition and the range and the impact force of washing fluid are excellent.

(4) Because of the type transmitting the magnetic force, the nozzle inside the closed system can be rotated from outside. For example, when applying to the high-pressure vessel, it is possible to rotate the inside nozzle from outside without having seal mechanism for axis.

EXAMPLE

Into a polymerization vessel with 7 $m^3$, 150 parts of deionized fluid and 0.04 parts of partially saponified polyvinyl alcohol were first charged, and, after the deaeration, 100 parts of vinyl chloride monomer were charged. Thereafter, various additives used ordinarily for the polymerization of vinyl chloride and the polymerization initiator were charged. The polymerization reaction was performed at 58° C. under stirring and, when the inner pressure of vessel dropped to 1 $kg/cm^2$, the polymerization was completed. After collecting the non-reacted monomer, the rotary washing nozzle of the invention, which was installed at an upper position of the polymerization vessel, was allowed to rotate (5 revolutions/minute) by rotating the outer magnetic portion outside the polymerization vessel with an electric motor and by rotating the inner magnetic portion inside the polymerization vessel accompanying with the rotation of outer magnetic portion to wash with a pressurized water of 10 kg/cm$^2$.

As a result of having continuously repeated the above procedure for 30 batches, the washing effect was good in all cases and the rotating portion of the washing nozzle also worked normally.

Besides, if the washing effect is insufficient, the fish eyes may increase on the molded articles when submitting the polymer obtained to molding processing, said increase was not observed in this example.

What is claimed is:

1. A rotary washing nozzle comprising:

a rotational portion connected to a rotational shaft, said rotational portion comprising blowing nozzle means, said rotational shaft being responsive to fluid pressure for rotating said rotational shaft;

means for supplying washing fluid to said rotary washing nozzle; and magnetic drive means for driving said rotational shaft;

wherein the drive speed of said magnetic drive means can be adjusted independently of said washing fluid pressure.

2. The rotary washing nozzle according to claim 1, wherein said nozzle is installed on a vessel of a closed system.

* * * * *